US005447445A

United States Patent [19]

Torii et al.

[11] Patent Number: 5,447,445

[45] Date of Patent: Sep. 5, 1995

[54] ELECTRIC CONNECTOR

[75] Inventors: Nozomu Torii, Hekinan; Shigeru Hayakawa, Chiryu; Masao Ohhashi, Kariya, all of Japan

[73] Assignee: Aisin Seiki Kabushiki Kaisha, Aichi, Japan

[21] Appl. No.: 285,517

[22] Filed: Aug. 4, 1994

[30] Foreign Application Priority Data

Aug. 5, 1993 [JP] Japan ..... 5-194690

[51] Int. Cl.[6] ..... H01R 13/52

[52] U.S. Cl. ..... 439/271; 439/206

[58] Field of Search ..... 439/271, 190–194, 439/206

[56] References Cited

U.S. PATENT DOCUMENTS 4,690,478 9/1987 Rahrig et al. ..... 439/271
4,715,380 12/1987 Harris ..... 128/419
5,276,307 1/1994 Higgins ..... 219/386

FOREIGN PATENT DOCUMENTS 9313963 7/1993 European Pat. Off. ..... 439/271

OTHER PUBLICATIONS

IBM Tech. Disclosure Bulletin, Air Operated Socket, K. Schoenfeld, vol. 20, No. 5, Oct. 1977, p. 1760.
"Connector and Cable for Automobile", Sumitomo Wiring Systems, Ltd., pp. 134–146, 1991–1992.

*Primary Examiner*—Larry I. Schwartz
*Assistant Examiner*—Jill DeMello
*Attorney, Agent, or Firm*—Burns, Doane, Swecker & Mathis

[57] ABSTRACT

An electric connector includes a case having a first space for accommodating an actuator and for communicating with the atmosphere. The case further includes a first connector having a first terminal for being electrically connected with the actuator. A second connector is also provided and includes a second terminal for communicating with an electric power source. The second connector is adapted to be engaged with the first connector so as to connect the first terminal with the second terminal at an engaging portion. A seal member is disposed in either the first connector or the second connector and is interposed between the first connector and the second connector so as to seal a second space located around the engaging portion at which the first connector engages the second connector. A through passage is also formed in the first connector to connect the first space with the second space.

4 Claims, 2 Drawing Sheets

ELECTRIC CONNECTOR

BACKGROUND OF THE INVENTION

1. Field of the invention

This invention relates to an electric connector, and in particular relates to an electric connector electrically connecting an actuator of a vehicle door lock apparatus with an electric power source.

2. Description of the Related Art

A conventional electric connector is disclosed on pages 134–146, '91–92 CONNECTOR AND CABLE FOR AUTOMOBILE Sumitomo Wiring Systems, Ltd., printed in Japan. The electric connector disclosed in the prior art comprises a first connector and a second connector which are connected to each other. The first connector includes a first terminal electrically connected with an electric actuator driven by electric power supplied from an electric power source. The second connector includes a second terminal electrically connected with the electric power source and used for fitting with the first terminal to electrically lead between the first connector and the second connector. A seal member is interposed between the first connector and the second connector so as to seal the first terminal and the second terminal from the atmosphere when the first connector and the second connector are engaged with each other.

However in accordance with the prior art, since the seal member is mounted between the first and second connectors, a space shut off from an outside of the connectors is formed around an engaging portion of the first and second terminals. An air pressure in the space is likely to be reduced to a negative pressure relative to that of the atmosphere by variations of the temperature. Therefore, air from the outside is absorbed into the first and second connectors through the seal member. Consequently, rainwater is also sucked into the connectors.

SUMMARY OF THE PRESENT INVENTION

It is an object of the present invention to provide an electric connector which can prevent rainwater from going there into.

It is another object of the present invention to provide an electric connector which is convenient to be manufactured.

It is a further object of the present invention to provide an electric connector which has durability.

It is a further object of the present invention to provide an electric connector which is simple in structure and small in size.

It is a further object of the present invention to provide an electric connector which is low in cost.

To achieve the above mentioned objects, an electric connector in accordance with this invention comprises a case including a first space for accommodating an actuator and for communicating with the atmosphere, and the case further including a first connector having a first terminal for being electrically connected with the actuator, a second connector including a second terminal for communicating with an electric power source, wherein the second connector is used for being engaged with the first connector so as to connect the first terminal with the second terminal at an engaging portion, a seal member interposed between the first connector and the second connector so as to seal a second space located around the engaging portion from the atmosphere when the first connector and the second connector are engaged and a through passage formed in the first connector so as to connect the first space with the second space.

BRIEF DESCRIPTION OF THE DRAWINGS

The features and advantages of the electric connector according to the present invention will be more clearly appreciated from the following description in conjunction with the accompanying drawings wherein.

FIG. I is a perspective view of an electric connector of the present invention.

DETAILED DESCRIPTION OF PREFERRED EMBODIMENT OF THE INVENTION

Figure 1:
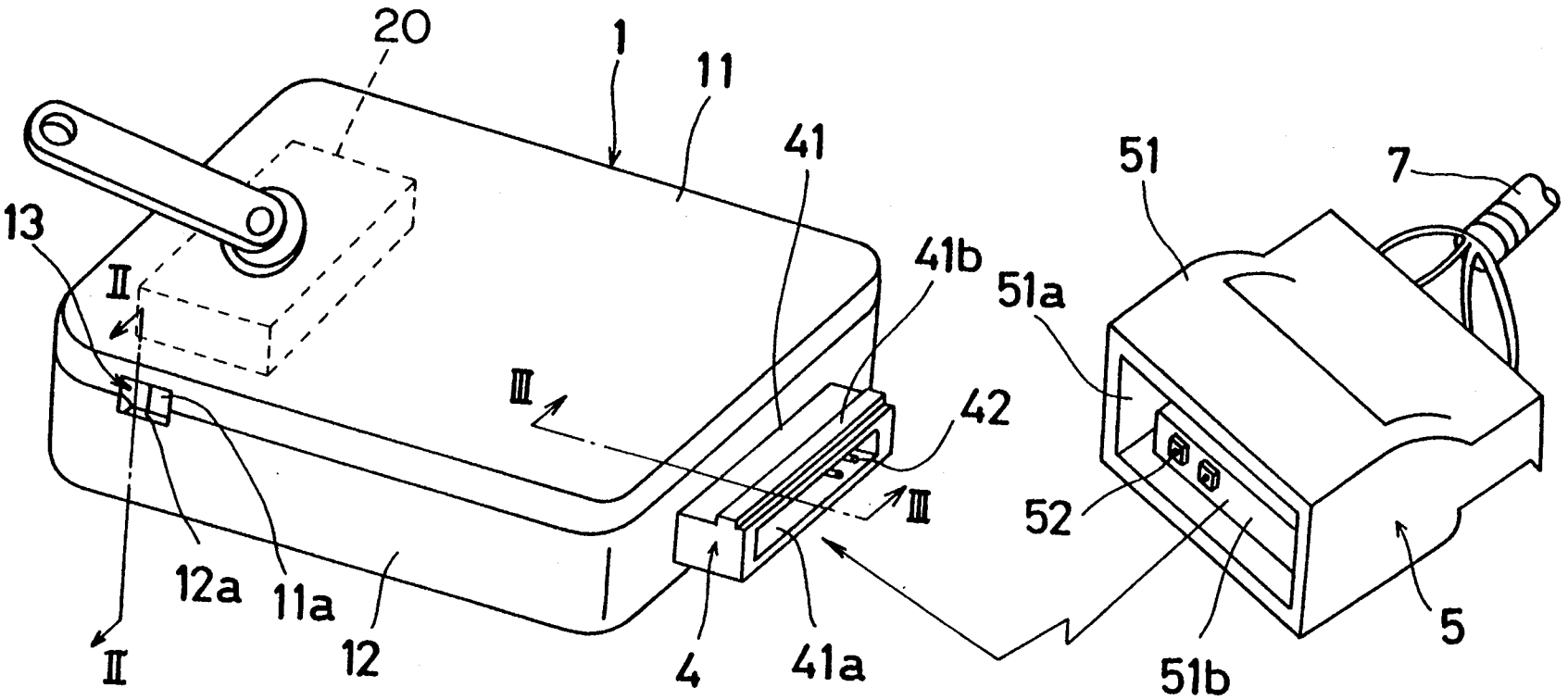
Figure 2:
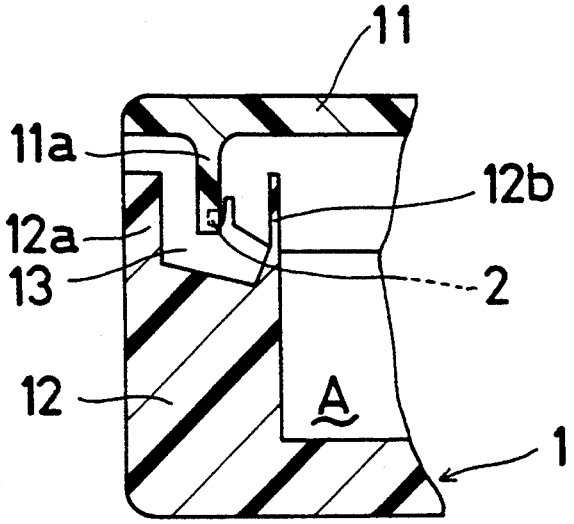
FIG. 2 is a sectional view of an electric connector of the present invention taken on line II—II of the FIG. 1.
Figure 3:
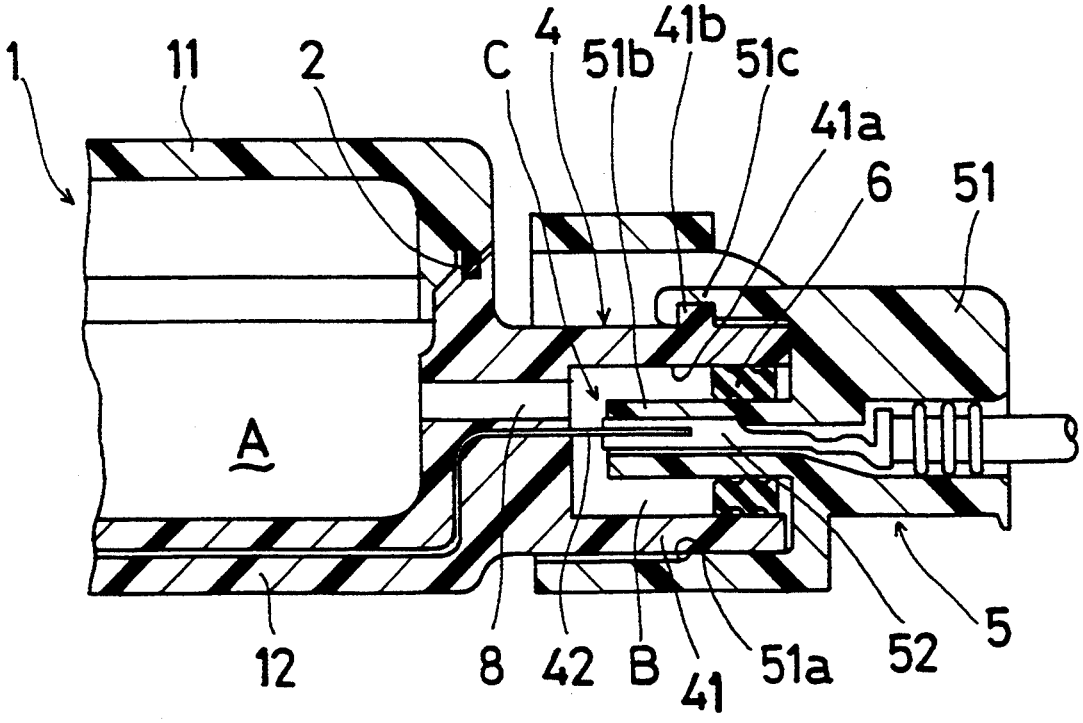
FIG. 3 is a sectional view of an electric connector of the present invention taken on line III—III of the FIG. 1.

Referring to the FIGS. I to 3, a case 1 includes an upper cover 11 and a lower cover 12 fixed to the upper cover 11 through a seal member 2. The seal member 2 prevents water from going into the case 1. The case 1 includes a space A therein for accommodating an actuator 20 which drives a vehicle door lock apparatus (not shown in the FIGURES). The case 1 further includes a passage 13 connecting the space A with the outside. The passage 13 is formed into a labyrinth by a combination of wall portions 11*a*, 12*a* and 12*b* formed at end portions of the upper cover 11 and the lower cover 12 alternately. Therefore, rainwater and dust are prevented from going into the space A through the passage 13.

The case 1 has a male connector 4. The male connector 4 includes a connector case 41 and a male terminal 42. The connector case 41 is formed at a side of the lower cover 12 so as to be projected from the lower cover 12. The connector case 41 includes a first concave portion 41*a* and an engaging portion 41*b*. The male terminal 42 is formed in the lower cover 12 by insert molding. One end of the male terminal 42 projects into the first concave portion 41*a* and the other end is connected to an electric motor (not shown in the FIGURES) of the actuator.

A female connector 5 for engaging with the male connector 4 is formed with a connector case 51 and a female terminal 52. The connector case 51 includes an opening 51*a* having a convex portion 51*b* and a second concave portion 51*c*. The convex portion 51*b* has a diameter which is smaller than that of the first concave portion 41*a* of the connector case 41 so as to be inserted into the first concave portion 41*a*. The second concave portion 51*c* can be engaged with the engaging portion 41*b* of the connector case 41. The female terminal 52 is disposed in the convex portion 51*b*. One end of the female terminal 52 projects from the convex portion 51*b* so as to be fit with the male terminal 42 of the male connector 4 and the other end of the female terminal 52 is connected to an electric power source (not shown in the FIGURES) through a cable 7. A seal member 6 is fit on the convex portion 51*b* for being fluid-tightly contacted with the first concave portion 41*a*. The constructions above mentioned are mounted in the vehicle door (not shown in the FIGURES).

In accordance with the above structure, the female connector 5 is engaged with the male connector 4 when the engaging portion 41*b* is fit into the second concave portion 51*c* so as to locate the convex portion 51*b* in the first concave portion 41*a*. The first and second terminals 42, 52 are engaged with each other by the engagement of the connectors 4, 5 so as to electrically connect the electric motor with the electric power source. At this time, the seal member 6 is contacted with an inner circumferential surface of the first concave portion 41a so as to shut off an engaging portion C of the terminals 42, 52 from the atmosphere. Therefore, rainwater is prevented from entering the engaging portion C. A space B is formed around the engaging portion C by the seal member 6 which shuts off the engaging portion C from the atmosphere.

A through passage 8 connecting the space A with the space B is formed in the lower cover 12. The space B communicates with the outside through the through passage 8 and the passage 13. For example, when the vehicle is washed on a hot day, the heated connecters 4, 5 are quickly cooled down. However, since the space B communicates with the atmosphere through the through passage 8, the space A and the passage 13, the air pressure in the space B is prevented from being reduced to a negative pressure relative to that of the outside. Therefore, the air and the rainwater are not absorbed into the space B through the seal member 6 so as to establish a waterproofing of the space B.

Further, because the through passage 8 connects the space B with the outside of the case 1 through the space A and the passage 13 formed in the shape of a labyrinth, the rainwater is prevented from going into the space B through the through passage 8. Therefore, the electric connector of the invention can reliably establish a waterproofing of the engaging portion C.

While the invention has been particularly shown and described with reference to a preferred embodiment thereof, it will be understood by those skilled in the art that the foregoing and other changes in form and details can be made therein without departing from the spirit and scope of the invention.

What is claimed is:

1. An electric connector comprising:

a case including a first space for accommodating an actuator and for communicating with an atmosphere, and the case further including a first connector having a first terminal for being electrically connected with the actuator;

a second connector including a second terminal for communicating with an electric power source, the second connector being engageable with the first connector to connect the first terminal with the second terminal at an engaging portion;

a seal member disposed in either the first connector or the second connector and interposed between the first connector and the second connector to seal from the atmosphere a second space located around the engaging portion when the first connector and the second connector are engaged with one another; and a through passage formed in the first connector to connect the first space with the second space.

2. An electric connector as recited in claim 1, wherein the first space communicates with the atmosphere through a labyrinth shaped passage formed in the case.

3. An electric connector as recited in claim 1, wherein the first connector is a male connector and the first terminal is a male terminal, said male connector including a connector case having an outer surface from which extends an engaging element.

4. An electric connector as recited in claim 3, wherein the second connector is a female connector and the second terminal is a female terminal, said female connector including a connector case having a concave portion that receives the engaging element when the male and female connectors engage one another.

* * * * *